US005644115A

United States Patent [19]

Knauer

[11] Patent Number: 5,644,115

[45] Date of Patent: Jul. 1, 1997

[54] RELAY MATRIX SWITCHING ASSEMBLY

[75] Inventor: William Knauer, Portage, Ohio

[73] Assignee: Keithley Instruments, Inc., Cleveland, Ohio

[21] Appl. No.: 436,018

[22] Filed: May 5, 1995

[51] Int. Cl.[6] ..... H01H 51/00; H01H 67/02; H01H 1/66

[52] U.S. Cl. ..... 200/175; 335/112; 335/151; 361/805

[58] Field of Search ..... 200/175–180; 335/106–140, 152; 361/647, 648, 728, 733–748, 749, 805; 307/112–139

[56] References Cited

U.S. PATENT DOCUMENTS

| | | | |
|---|---|---|---|
| 3,454,911 | 7/1969 | Rouzier et al. | 361/749 X |
| 3,500,267 | 3/1970 | Wasserman | 335/112 |
| 3,718,876 | 2/1973 | Fletcher | 335/112 X |
| 3,789,332 | 1/1974 | Jameel et al. | 335/112 X |
| 3,824,433 | 7/1974 | Newton, Jr. | 361/805 |
| 4,019,164 | 4/1977 | Deeg | 200/175 X |
| 4,088,385 | 5/1978 | Adkins | 29/860 |
| 5,049,844 | 9/1991 | Mustafa | 335/128 X |
| 5,281,762 | 1/1994 | Long et al. | 174/78 |
| 5,559,482 | 9/1996 | Close et al. | 335/151 |

*Primary Examiner*—J. R. Scott

*Attorney, Agent, or Firm*—Pearne, Gordon, McCoy & Granger LLP

[57] ABSTRACT

A matrix of three pole, high speed, low current relays for connecting test equipment to a device under test is provided with improved interconnect buses. The relays are mounted in rows and columns with their three pairs of leads extending vertically. An input interconnect bar having three conductors extends horizontally along each row of relays, each conductor being connected to a respective one of each pair of leads. A bottom interconnect bar having three buses extends perpendicular to the top interconnect bars along each column of relays, each bus being connected to a respective one of the leads. The ends of the leads are aligned at a 45° angle with respect to the interconnects. The interconnect bars are enclosed in shielding guard tubes and are removable to permit replacement of the relays.

30 Claims, 8 Drawing Sheets

32
32
34
31
10
30
94
20
29
27
92
29A
18
22
12
14
20
18
28
92
28
26
24
24

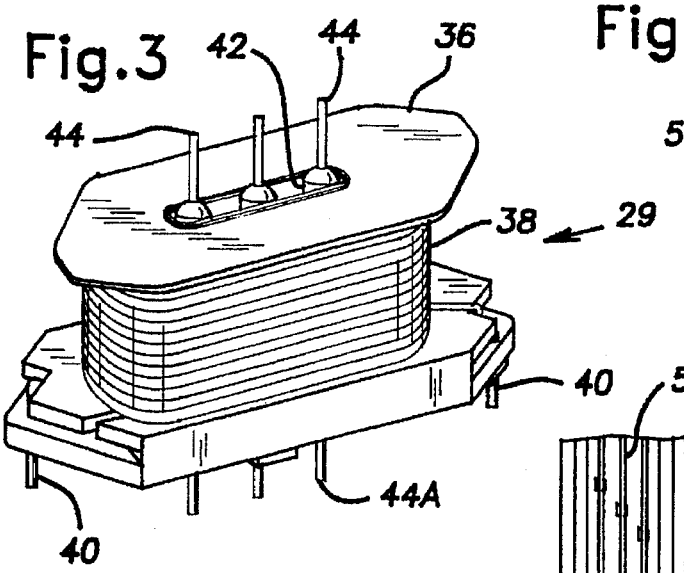
Fig.3
42
44
36
44
38
29
40
44A
40
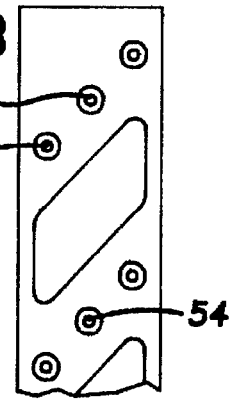
Fig.2B
56
54
54
59
58
50
52
58
32
2B
2B
30
34
Fig.2A
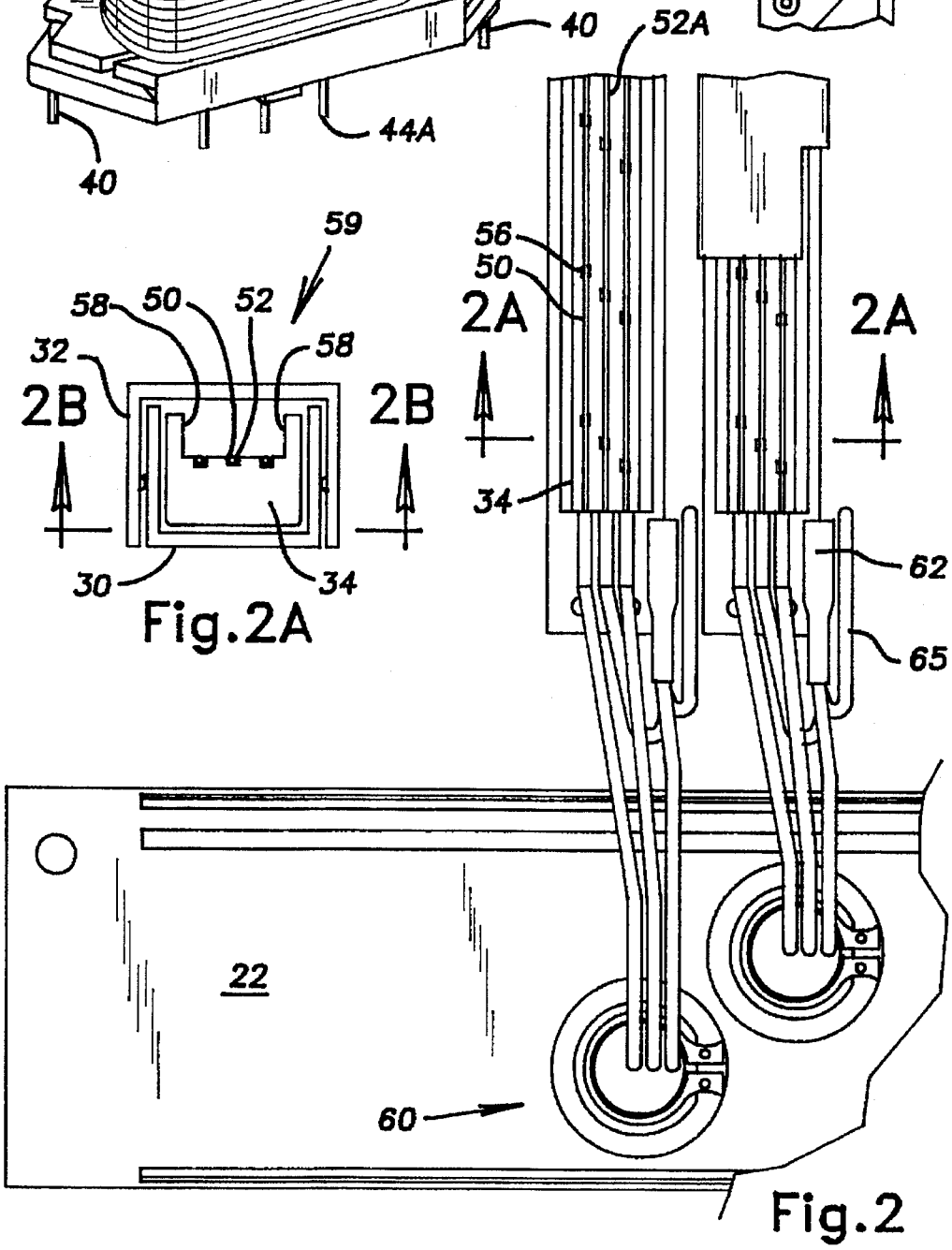
52A
56
50
2A
2A
34
62
65
22
60
Fig.2

RELAY MATRIX SWITCHING ASSEMBLY

BACKGROUND OF THE INVENTION

1. Field of the Invention

This invention relates generally to the field of electronic device testing and specifically to a relay switching matrix assembly.

2. Description of the Related Art

Electronic instruments are used to test and analyze the performance of electronic equipment, devices, and circuits. A plurality of test leads are connected between selected points in the equipment, device, or circuit and selected instruments to perform the desired tests. To reduce the number of test instruments required and to minimize the need for reconnecting test leads at different points, the leads are connected to the test instruments through a switching matrix. The switching matrix uses a plurality of relays that are controlled to connect selected test leads to selected inputs of the test instruments. During the course of a test the leads may be sequentially connected to several different inputs or instruments by the matrix.

The relays commonly have three switching elements or poles adapted to switch three conductors of the test circuit, typically a pair of signal conductors and a shield. The relays are preferably of the type described in U.S. Pat. No. 5,559,482, assigned to the assignee of this invention and incorporated herein by reference.

The relays are mounted on a printed circuit board with the leads of the relays being soldered to matrix circuits through holes in the board. The matrix circuits include a plurality of input circuits connectable to the device under test through the test leads, and a plurality of pathway circuits connectable to the test instruments by pathway leads. Polytetrafluoroethylene is commonly used as an insulator, creating triboelectric effects. The relays are controlled to interconnect selected input circuits with selected pathway circuits. The switching is done at high speeds to enable a large volume of test data to be collected in a short time. However, the switching must permit time for transient states to settle, allowing testing to be done at a steady state.

Dielectric absorption in the matrix has been a source of errors and delays in reaching a steady state reading during testing. A relay matrix is sought that reduces the dielectric absorption of the prior art matrices. The matrix should be arranged to minimize circuit lengths and insulation required, thereby reducing losses, as well as noise, interference, and other problems. In addition, it is desirable to have an improved switching matrix that provides effective shielding of the circuits and relays to reduce noise and interference. It is also desirable to provide for simple and efficient removal and replacement of relays, which occasionally fail.

SUMMARY OF THE INVENTION

The present invention provides a relay matrix having a plurality of controllable switches arranged in a plurality of rows and columns, each switch having first and second leads extending therefrom. A plurality of input conductors correspond to respective columns and are connectable to the first leads of the switches in the corresponding column. A plurality of pathway conductors each correspond to respective rows and are connectable to the second leads of the switches in the corresponding row. The switches are controllable to selectively interconnect corresponding input and pathway conductors and the switches are disposed between the corresponding input and pathway conductors.

The input conductors are disposed in columns defining a first plane, the pathway conductors are disposed in rows defining a second plane, and the switches are disposed between the first and second planes. The first and second planes are parallel and the switches include leads extending generally normal to the first and second planes. The matrix also includes a board on which the switches are mounted. The input conductors are disposed on one side of the board and the pathway conductors are disposed on an opposite side of the board. The conductors are removably and frictionally connectable to the switches. Shielding is also provided around the conductors.

According to one embodiment of the invention, the relay matrix includes a plurality of relays, each relay including a switching element having first and second leads. A plurality of first conductors are connectable with the first leads of corresponding switching elements. A plurality of first interconnect bars each support one of the first conductors. A plurality of second conductors, are connectable with the second leads of corresponding switching elements. A plurality of second interconnect bars each support one of the second conductors, so as to permit connection of a selected one of said first conductors with a selected one of said second conductors by operation of the relays.

The matrix includes a plurality of guard tubes, each interconnect bar being disposed in a guard tube. Each guard tube includes a plurality of holes corresponding to the relays to which the conductors are connectable, the leads passing through the holes. Each guard tube is metallic and is electrically connected to the conductor in the corresponding guard tube. The conductor connected to the guard tube is connected to a shielding circuit. A plurality of relay connectors are disposed in the interconnect bars and are adapted to removably connect each lead to the corresponding conductor. A control circuit is connected to operate selected relays.

A plurality of input connectors are each connected to a corresponding one of the first conductors and are adapted to be connected to a device under test. A plurality of pathway connectors are each connected to a corresponding one of the second conductors and are adapted to be connected to a test apparatus.

According to another aspect of the invention, an improved relay matrix includes a board and a plurality of relays mounted on the board. Switching elements of each of the relays have first and second leads. A plurality of input circuits connect columns of the first leads to corresponding input connectors. A plurality of pathway circuits connect rows of the second leads to corresponding pathway connectors. The matrix permits interconnection of selected input connectors and pathway connectors by operation of the relays. The relays are disposed between the input circuits and the pathway circuits.

The input circuits comprise generally linear buses arranged in parallel columns, and the pathway circuits comprise generally linear buses arranged in parallel rows disposed skew relative to said input buses. The first and second leads of each relay define a line intersecting one of the input circuits and one of the pathway circuits. Each circuit comprises two parallel conductors and each relay comprises two switching elements each having first and second leads connected to respective conductors of the circuits. The leads define a line perpendicular thereto and skew relative to the circuits. Shielding for the buses comprises metallic guard tube. Each bus is a conductor supported in an insulating interconnect bar and surrounded by a guard tube. Each guard tube is electrically connected to the conductor of the corresponding circuit. A plurality of connectors are mounted on the interconnect bar. Each connector frictionally connects one of the leads to a corresponding conductor. The conductors are recessed in channels spacing the conductors from the guard tube. Each relay includes three of the switching elements and each bus includes three circuits. The leads of the switching elements are connected to corresponding circuits of corresponding buses. Preferably, Each bus comprises three conductors, one corresponding to each circuit, supported in an insulating interconnect bar and surrounded by a guard tube. Each guard tube is electrically connected to one of the circuits of the corresponding bus. The circuit to which the guard tube is connected is a shielding circuit. Switching elements are removably connected to the circuits. A controller operates the relays.

The matrix of the invention reduces dielectric absorption and triboelectric effects. The invention reduces the duration of transient states over prior art embodiments thereby permitting increased switching rates to collect more data in less time.

BRIEF DESCRIPTION OF THE DRAWINGS

FIG. 2 shows a detailed partial view of rear face of an input panel and partially disassembled interconnect buses;

FIG. 2A shows a sectional view of an interconnect bus taken from line 2A—2A of FIG. 2;

FIG. 2B shows a detailed partial view of a bottom face of an interconnect bar;

FIG. 3 shows an isometric view of a relay;

DESCRIPTION OF THE PREFERRED EMBODIMENTS

Figure 1:
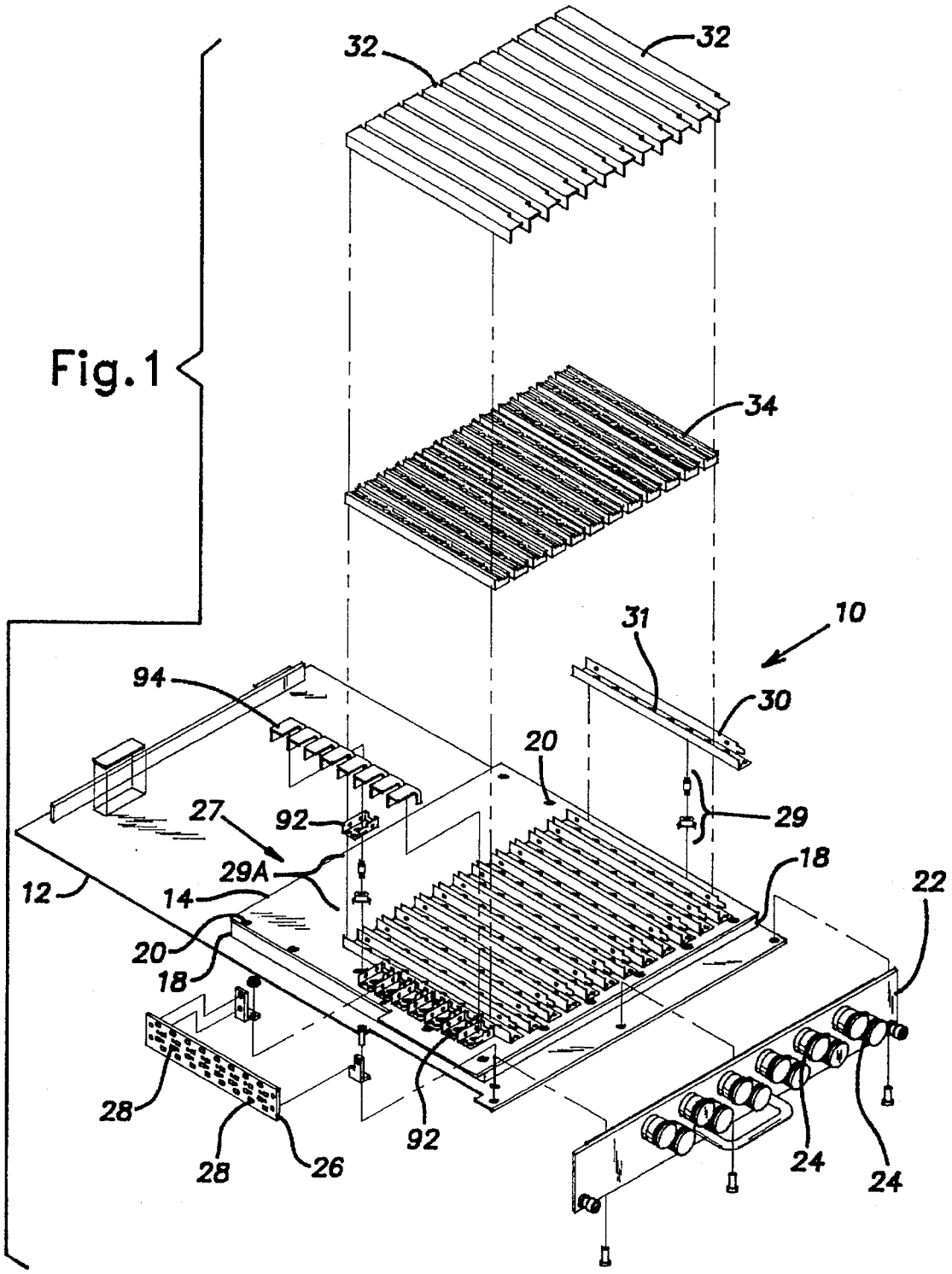
FIG. 1 shows an exploded view of a switching matrix according to the invention.

Referring to FIG. 1, a switching matrix 10 includes a mother board 12 and a relay board 14, each made of a material suitable for printed circuit boards. In the cabinet mounted configuration shown, the relay board 14 fits over a conforming opening 16 (FIG. 6) in the mother board 12, the opening 16 being slightly smaller than the relay board 14. The relay board 14 is spaced from the mother board 12 by several insulating spacers 18, and the boards 12, 14 are fastened together by screws 20.

An input panel 22 is mounted on an end of the mother board 12 and has installed thereon a plurality of input connectors 24. A pathway panel 26 is mounted on a top face 27 along an edge of the relay board 14 and has installed thereon a plurality of pathway connectors 28. A plurality of relays 29 are mounted on the top face 27 of the relay board 14, as discussed below. A plurality of input guard tube bases 30 are arranged in parallel columns over the relays 29. Holes 31 in the bases 30 correspond with relays 29 mounted on the board 14. Each hole 31 permits passage of a relay 29 therethrough. Each input guard tube base 30 is provided with a corresponding input guard tube cover 32. The guard tube base 30 and cover 32 mate to form a hollow, generally parallelepipedic guard tube with one open end. The base 30 and cover 32 are preferably made from stamped steel having overlapping sides for a snap fit. An interconnect bar 34 is disposed in each of the guard tubes, as discussed below.

Referring to FIG. 3, each relay 29 includes a bobbin 36 wound with an operating coil 38. The operating coil 38 terminates at a pair of coil leads 40. Switching elements, such as reeds 42, are removably disposed in the bobbin 36 so as to be surrounded and operated by the coil 38. Each reed 42 includes a pair of relay leads 44 extending therefrom and connectable to a circuit to be switched. Bottom leads 44*a* are long enough to extend through the relay board 14.

Figure 4:
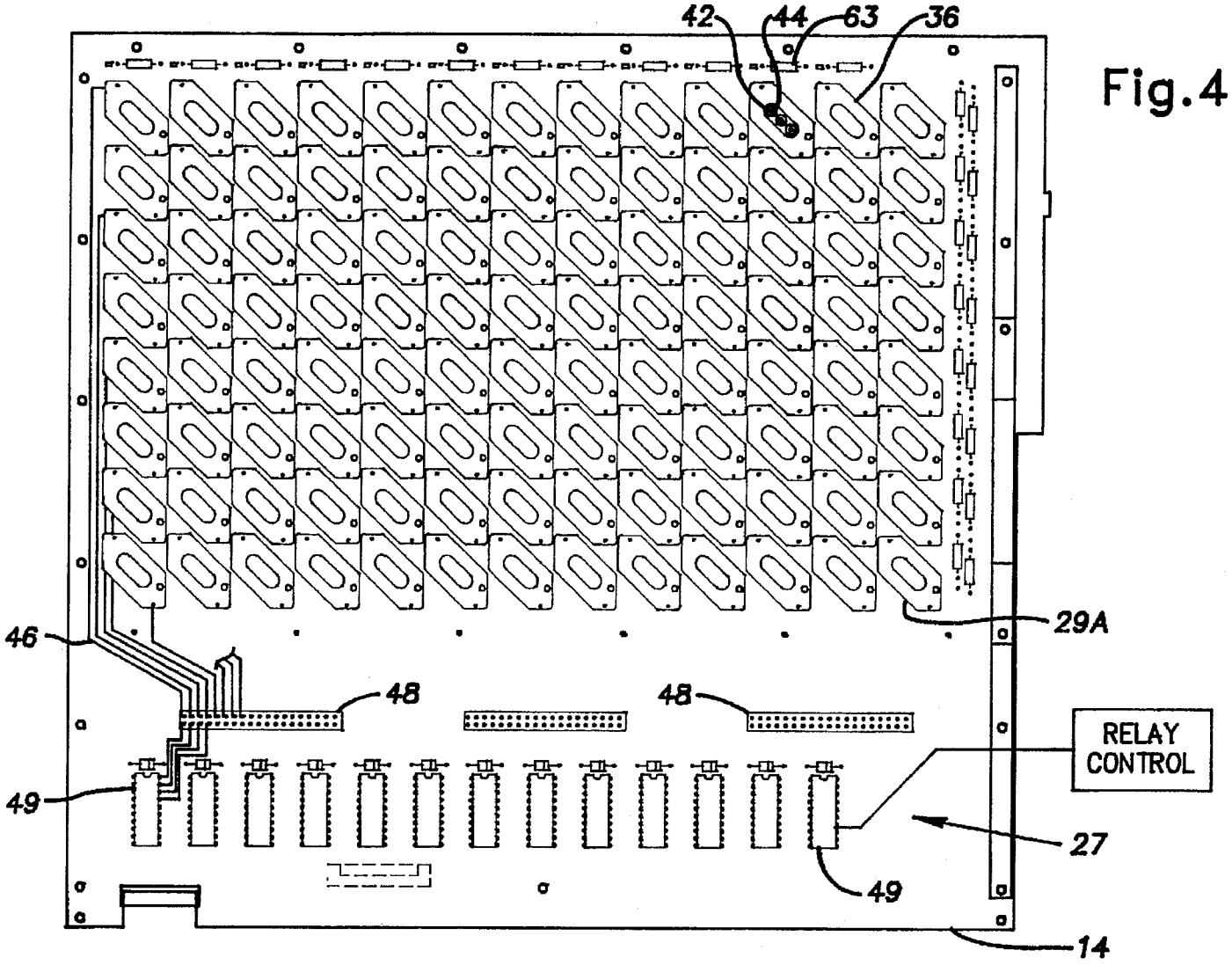
FIG. 4 shows a plan view of front face of a relay board.

As shown in FIG. 4, the bobbins 36 are mounted on the top face 27 of the relay board 14 in a matrix arrangement having vertical columns and horizontal rows. The coil leads 40 extend through holes in the relay board 14 and are soldered to relay control circuits 46 (partially shown) in the relay board 14. The relay control circuits 46 are printed on the relay board 14 and are connected to test connectors 48 and logic circuits 49 adapted to be connected to a relay controller. The relay circuits 46 may be printed on either or both faces of the relay board 14. The bobbins 36 are installed at an angle, preferably 45°, such that a line intersecting and normal to the leads 44 of the reeds 42 in the bobbin 36 is skew relative to the columns and rows. As will become apparent, this enables interconnection of selected circuits with minimum lead lengths.

Referring to FIGS. 2, 2A, and 2B, each interconnect bar 34 has a generally rectangular cross section. Three longitudinally extending, parallel channels 50 have mounted therein copper circuit conductors 52. Holes 54 are drilled through the interconnect bar 34 in sets of three corresponding to the relays 29 and leads 44. Each hole 54 is aligned with one of the channels 50 and corresponding conductors 52. Each set of three is aligned at an angle of approximately 45° with respect the longitudinal axis of the interconnect bar 34. A relay connector 56 is disposed in each of the holes 54. Each relay connector 56 is electrically connected to a corresponding one of the conductors 52 and is adapted to receive one of the relay leads 44 therein. When the relay matrix 10 is assembled, the leads 44 are frictionally, but removably, held in the connectors 56 to connect the relay reeds 42 to the corresponding conductors 52.

The interconnect bar 34, preferably made from polyphenylene sulfide resin (Ryton®), rests between the guard tube base 30 and the guard tube cover 32. Spacer flanges 58 or an insulating insert are provided to space the conductors 52 from the guard tube components 30, 32. The guard tube cover 32 is adapted to snap onto or frictionally fit on the guard tube base 30. Each assembly of guard tube base 30, cover 32, interconnect bar 34, conductors 52, and relay connectors 56 comprises an interconnect bus 59.

The conductors 52 are electrically connected to input connectors 60 mounted on the input panel 22. Each set of three conductors 52 is connected to corresponding contacts on a corresponding three conductor input connector 60. Preferably the center conductor 52A is connected to a shielding or guarding circuit through the input connector 60 and is also connected to the guard tube base 30 by a slide connector 62 on a tab of the base 30. Referring to FIGS. 2 and 4, the shielding circuit of the center conductor 52A should also be connected to a bleed resistor 63 by a bleed lead 65 from the slide connector 62. The bleed resistor 63 is connected to the relay board 14.

Figure 7:
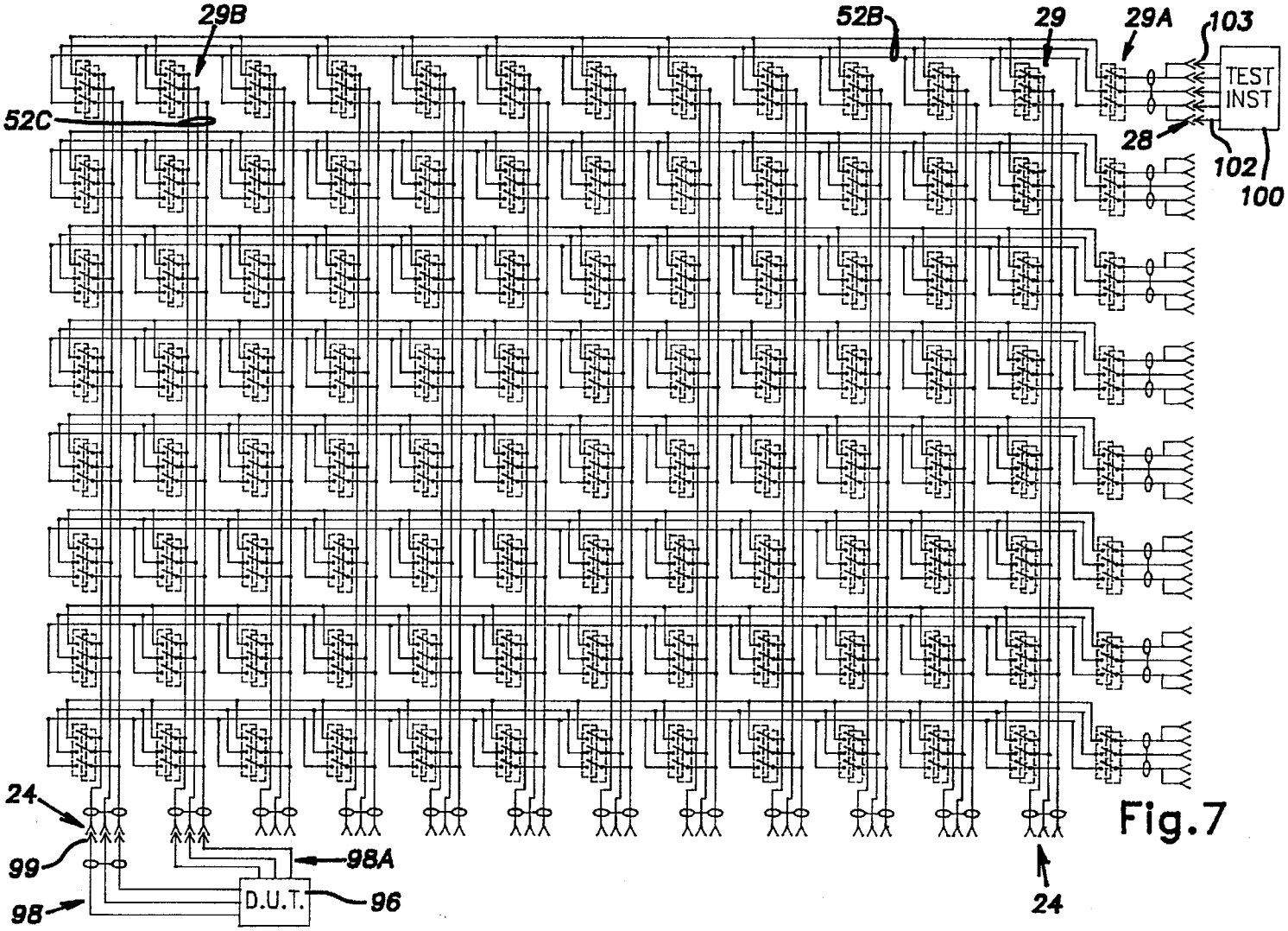
FIG. 7 shows a schematic electrical diagram of the relay matrix.
Figure 10:
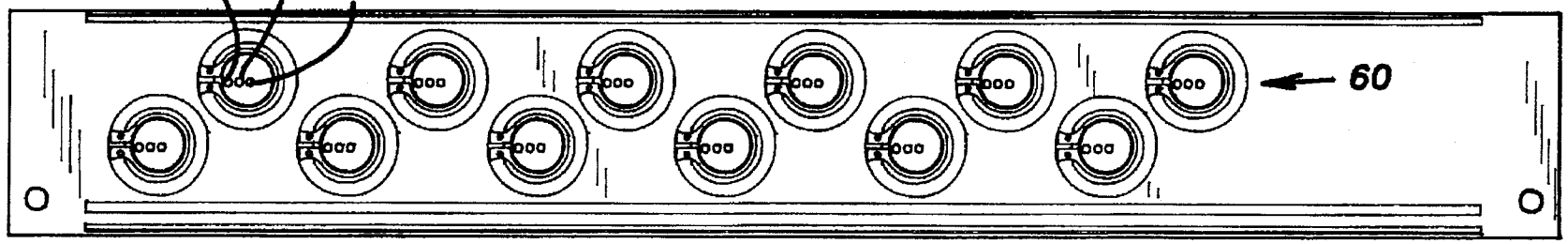
FIG. 10 shows an elevational view of a rear face of an input panel.
Figure 11:
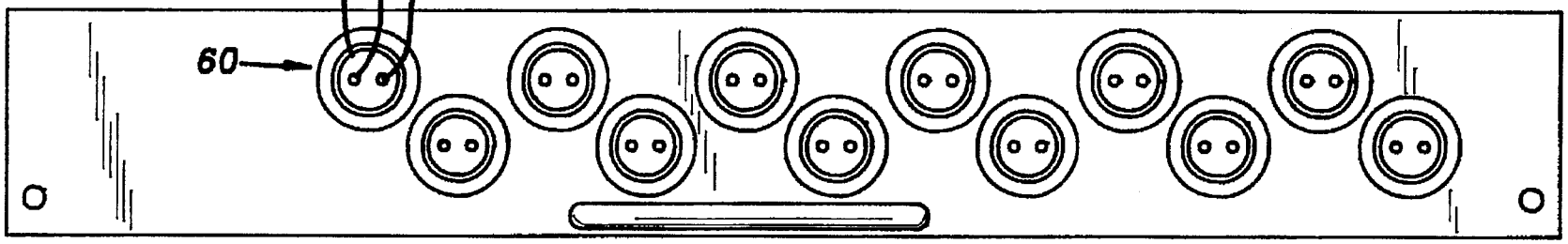
FIG. 11 shows an elevational view of a front face of the input panel.

Referring to FIGS. 10 and 11, the input connectors 60 are preferably standard three conductor connectors having a pair of signal contacts 64 surrounded by a shield contact 66. As shown in FIG. 7, each connector 60 is adapted to mate with a test lead connector 99 from a test lead 90 connectable to a device under test 96.

Figure 5:
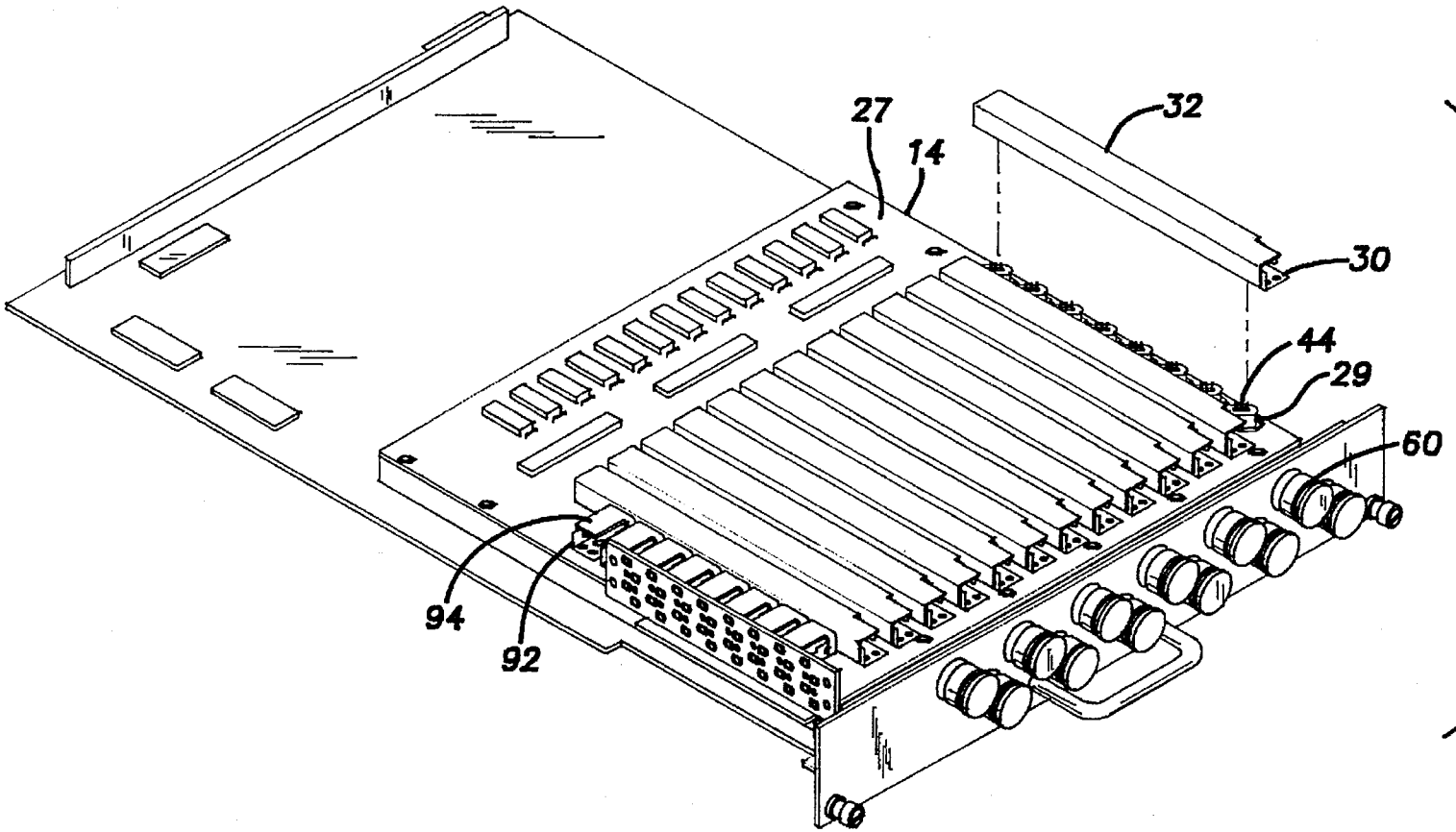
FIG. 5 shows an isometric view of a front face of the relay matrix.

As shown in FIG. 5, the input guard tube bases 30 and covers 32 are installed on the relays 29 on the front face 27 of the relay board 14 in columns corresponding with the columns of relays 29. In FIG. 5, wires connecting the conductors 52 to the input connectors 60 have been omitted for clarity. Each upwardly extending relay lead 44 fits in a corresponding relay connector 56 of the interconnect bar 34.

Figures 6, 6A:
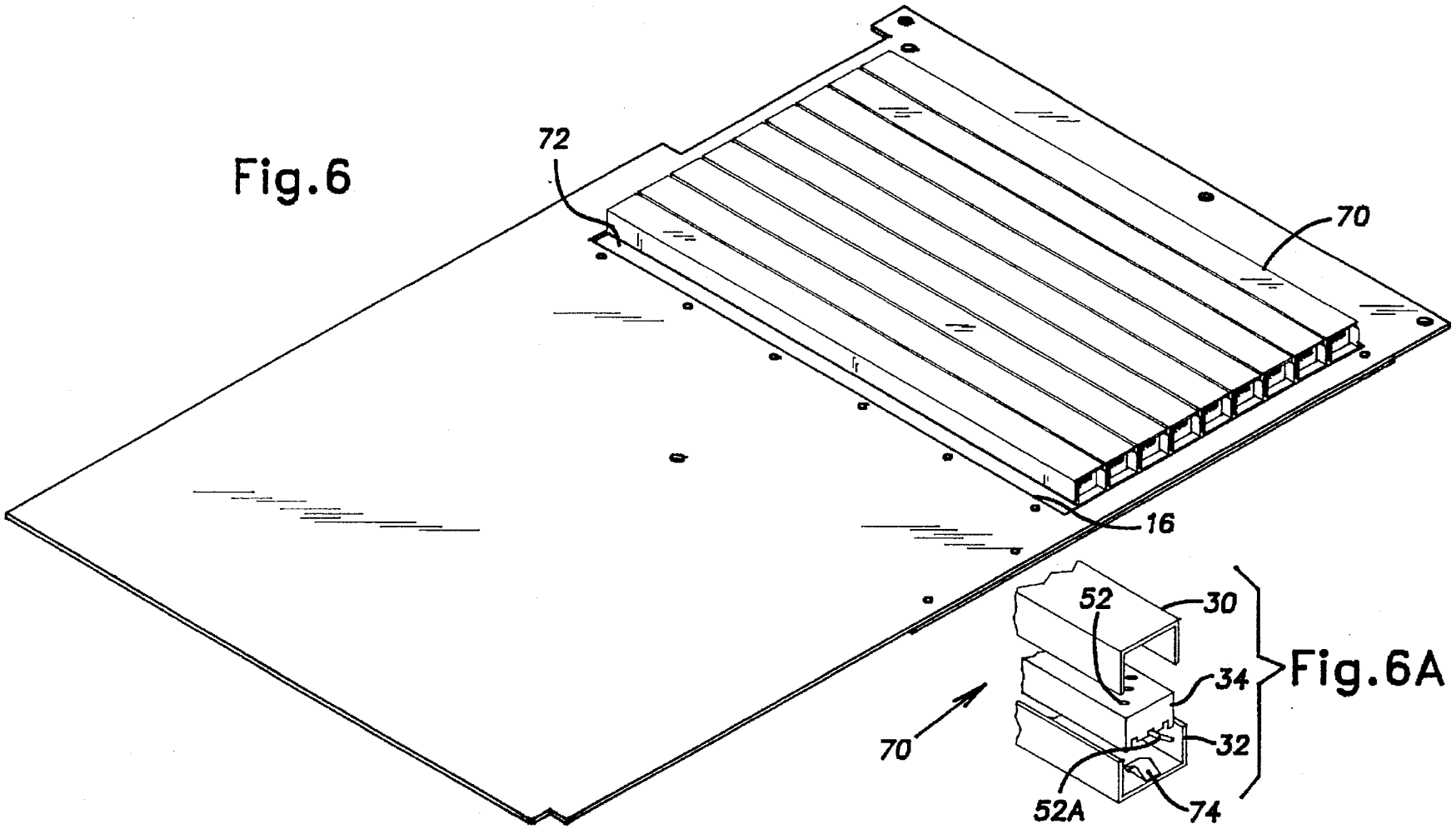
FIG. 6 shows an isometric view of a rear face of the relay matrix.
FIG. 6A shows an exploded detail view of an end of a guard tube and interconnect bar.

Referring to FIG. 6, pathway guard tubes 70 are installed on a rear face 72 of the relay board 14. The pathway guard tubes 70 are similar to the input guard tubes 30, 32 previously described and have installed therein similar interconnect bars 34, conductors 52 and relay connectors 56. The only substantial difference is that the slide connector 62 and tab are omitted. Instead, the pathway guard tube 70 is electrically connected to an extension of the corresponding center conductor **52*a* by a spring contact 74, as shown in FIG. 6A. The pathway guard tubes 70 and interconnect bars 34 are arranged in rows corresponding with the rows of relays 29. Each downwardly extending relay lead 44*a* extends through the relay board 29 and fits in a corresponding connector 52 of the pathway interconnect bar 34**.

Figure 8:
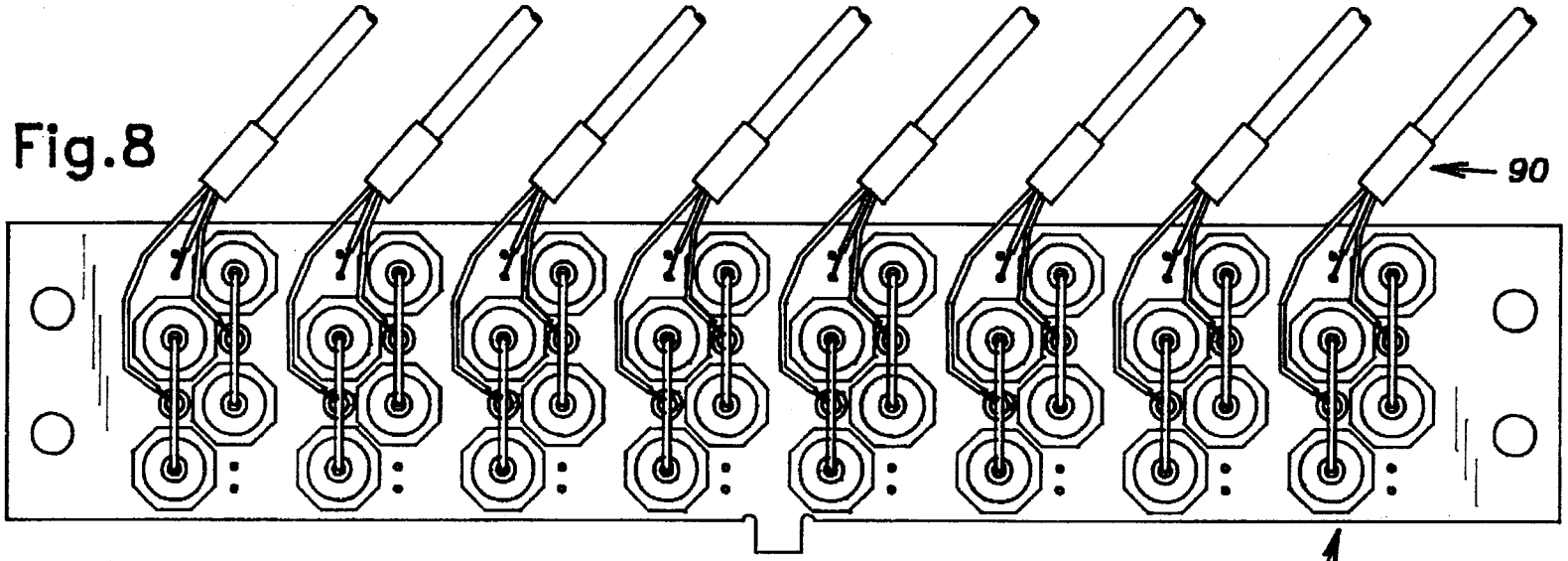
FIG. 8 shows an elevational view of a rear face of a pathway panel.
Figure 9:
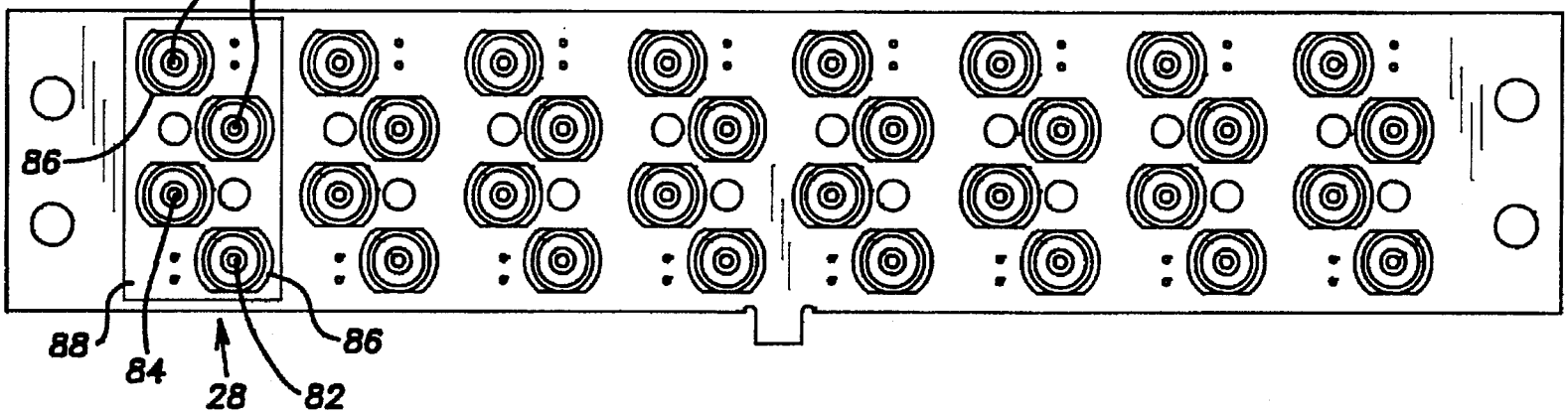
FIG. 9 shows an elevational view of a front face of the pathway panel.

Referring to FIGS. 7, 8, and 9, the pathway conductors 52 are electrically connectable to corresponding pathway connectors 28. Each pathway connector includes two pairs of signal contacts 82, 84. Each signal contact 82, 84 is surrounded by a shield contact 86, the shield contacts being electrically interconnected by a conductive shield plate 88. The pathway connectors are connectable to corresponding pathway leads 102 by mating pathway lead connectors 103.

Suitable wires 90 or leads connect the respective contacts 82, 84, 86 of the pathway connectors 28 to upwardly extending leads 44 of row selecting relays **29*a* in the column adjacent the pathway panel 26. As shown in FIGS. 1 and 5, the column of relays 29 adjacent the pathway panel 26 is not provided with the input guard tube cover 32 and base 30. Instead, a separate, shorter row selecting guard tube base 92 and cover 94 are provided on each row selecting relay 29*a* in the column adjacent the pathway connectors 28. The row selecting guard tube 92, 94 is substantially identical to the input guard tube 30, 32 except that it is long enough to cover only one relay 29*a* and is disposed perpendicular to the rows of input guard tubes. Each row selecting guard tube cover 32 is electrically connected to the corresponding shield contact 86 and center lead 44 of the row selecting relay 29*a* by a slide connector 62 similar to the connection shown in FIG. 2**.

Referring to FIG. 7, each row selecting relay **29*a* is adapted to selectively connect its corresponding pathway connector 28 to the corresponding set of three pathway conductors 52*b***.

In operation, circuits of a device under test (DUT) 96 are connected to the input connectors 24 with suitable test leads 98 and mating connectors 99. One or more test instruments 100 are connected to the pathway connectors 28 by pathway leads 102 and mating connectors 103. The relay controller 49 controls each of the relays 29 to selectively connect one of the sets of pathway conductors **52*b* with one of the sets of input conductors 52*c*. For example, the relay 29*b* at the second column and first row of the matrix is closed by the relay controller 49 to connect the second set of input conductors 52*c* with the first set of pathway conductors 52*b*. Then, the row selecting relay 29*a* is closed to connect the first set of pathway conductors 52*b* with the test instrument 100. Thus, the second set of test leads 98*a* is connected to the test instrument 100 to provide a path for test signals or data. Other circuits of the DUT 96 can similarly be connected to other test equipment inputs. According to the matrix shown, any of the input connectors 24 can be connected to any of the pathway connectors 28** sequentially or simultaneously. The matrix is adapted for high speed switching to enable many different tests to be performed on different circuits in a short time without moving the test or pathway leads.

Referring again to FIGS. 1 and 5, the reeds 42 are easily removed by removing the corresponding input interconnect bus (guard tube 30, 32 and interconnect bar 34) and pulling a set of three reeds 42 out of the bobbin 36 and out of the relay connectors 56 in the corresponding pathway interconnect bar 34. The new reeds are inserted in the relay connectors 56, then the interconnect bus 34 is replaced on the relay leads 44 of the corresponding column.

The present disclosure describes several embodiments of the invention, however, the invention is not limited to these embodiments. Other variations are contemplated to be within the spirit and scope of the invention and appended claims.

What is claimed is:

1. A relay matrix, comprising:

a plurality of controlled switches arranged in a plurality of rows and columns, each switch having first and second leads extending therefrom;

a plurality of input conductors, each corresponding to one of the columns and removably connected to the first leads of the switches in the corresponding column;

a plurality of pathway conductors, each corresponding to one of the rows and removably connected to the second leads of the switches in the corresponding row; and said switches being controlled to selectively interconnect corresponding input and pathway conductors, and said switches being disposed between the corresponding input and pathway conductors.

2. A relay matrix according to claim 1, wherein the input conductors are disposed in columns defining a first plane, the pathway conductors are disposed in rows defining a second plane, and the switches are disposed between the first and second planes.

3. A relay matrix according to claim 2, wherein the first and second planes are parallel.

4. A relay matrix according to claim 2, wherein the switches include leads extending generally normal to the first and second planes.

5. A relay matrix according to claim 1, further comprising a board on which the switches are mounted, the input conductors being disposed on one side of the board and the pathway conductors being disposed on an opposite side of the board.

6. A relay matrix according to claim 1, wherein the conductors are frictionally connected to the switches.

7. A relay matrix, comprising:

a plurality of controlled switches arranged in a plurality of rows and columns, each switch having first and second leads extending therefrom;

a plurality of input conductors, each corresponding to one of the columns and connected to the first leads of the switches in the corresponding column;

a plurality of pathway conductors, each corresponding to one of the rows and connected to the second leads of the switches in the corresponding row;

said switches being controlled to selectively interconnect corresponding input and pathway conductors, and said switches being disposed between the corresponding input and pathway conductors; and shielding provided around the conductors.

8. A relay matrix, comprising:

a plurality of relays, each relay including a switching element having first and second leads;

a plurality of first conductors, each connectable with the first leads of corresponding switching elements;

a plurality of first interconnect bars each supporting one of the first conductors;

a plurality of second conductors, each connectable with the second leads of corresponding switching elements; and a plurality of second interconnect bars each supporting one of the second conductors, so as to permit connection of a selected one of said first conductors with a selected one of said second conductors by operation of the relays.

9. A relay matrix according to claim 8, further comprising a plurality of guard tubes, each interconnect bar being disposed in a guard tube.

10. A relay matrix according to claim 9, wherein each guard tube includes a plurality of holes corresponding to the relays to which the conductors are connectable, the leads passing through the holes.

11. A relay matrix according to claim 9, wherein each guard tube is metallic and is electrically connected to the conductor in the corresponding guard tube.

12. A relay matrix according to claim 11, wherein the conductor connected to the guard tube is connected to a shielding circuit.

13. A relay matrix according to claim 8, further comprising a plurality of relay connectors disposed in the interconnect bars and that removably connect each lead to the corresponding conductor.

14. A relay matrix according to claim 8, further comprising a control circuit connected to operate selected relays.

15. A relay matrix according to claim 8, further comprising a plurality of input connectors each connected to a corresponding one of the first conductors and adapted to be connected to a device under test, a plurality of pathway connectors each connected to a corresponding one of the second conductors and adapted to be connected to a test apparatus.

16. An improved relay matrix, including a board; a plurality of relays mounted on the board, switching elements of each of the relays having first and second leads; a plurality of input connectors; a plurality of input circuits connecting columns of the first leads to corresponding input connectors; a plurality of pathway connectors; a plurality of pathway circuits connecting rows of the second leads to corresponding pathway connectors, so as to permit interconnection of selected input connectors and pathway connectors by operation of the relays, wherein the improvement comprises:

the relays being disposed between the input circuits and the pathway circuits;

the first leads being removably connected to the input circuits; and the second leads being removably connected to the pathway circuits.

17. A relay matrix according to claim 16, wherein the input circuits comprise generally linear buses arranged in parallel columns, and said pathway circuits comprise generally linear buses arranged in parallel rows disposed skew relative to said input buses.

18. A relay matrix according to claim 17, wherein the first and second leads of each relay define a line intersecting one of the input circuits and one of the pathway circuits.

19. A relay matrix according to claim 18, wherein each circuit comprises two parallel conductors and each relay comprises two switching elements each having first and second leads connected to respective conductors of the circuits, said first leads defining a second line perpendicular to the first leads and intersecting the first leads, said second line being skew relative to the circuits.

20. A relay matrix according to claim 17, further comprising shielding for the buses.

21. A relay matrix according to claim 20, wherein the shielding comprises metallic tube.

22. A relay matrix according to claim 17, wherein each bus comprises a conductor supported in an insulating interconnect bar and surrounded by a guard tube.

23. A relay matrix according to claim 22, wherein each guard tube is electrically connected to the conductor of the corresponding circuit.

24. A relay matrix according to claim 23, further comprising a plurality of connectors mounted on the interconnect bar, each connector frictionally connecting one of the leads to a corresponding conductor.

25. A relay matrix according to claim 22, wherein the conductors are recessed in channels spacing the conductors from the guard tube.

26. A relay matrix according to claim 17, wherein each relay includes three of the switching elements and each bus includes three circuits, the leads of the switching elements being connected to corresponding circuits of corresponding buses.

27. A relay matrix according to claim 26, wherein each bus comprises three conductors, one corresponding to each circuit, supported in an insulating interconnect bar and surrounded by a guard tube.

28. A relay matrix according to claim 27, wherein each guard tube is electrically connected to one of the circuits of the corresponding bus.

29. A relay matrix according to claim 28, wherein the circuit to which the guard tube is connected is a shielding circuit.

30. A relay matrix according to claim 16, further comprising a controller for operating the relays.

* * * * *

UNITED STATES PATENT AND TRADEMARK OFFICE

CERTIFICATE OF CORRECTION

PATENT NO. : 5,644,115

DATED : July 1, 1997

INVENTOR(S) : William Knauer

It is certified that error appears in the above-indentified patent and that said Letters Patent is hereby corrected as shown below:

Col. 8, line 38, please delete "23," and insert therefore --22,--.

Signed and Sealed this

Eleventh Day of November, 1997

*Attest:*

Bruce Lehman

BRUCE LEHMAN

*Attesting Officer*

*Commissioner of Patents and Trademarks*